US006203006B1

(12) United States Patent
Semanick et al.

(10) Patent No.: US 6,203,006 B1
(45) Date of Patent: Mar. 20, 2001

(54) SHEET-SIZE AND STACKING DIRECTION ADJUSTABLE ACCUMULATOR WITH REMOVABLE RAMPS AND METHOD

(75) Inventors: John J. Semanick, Bethlehem; John H. Vitko, Easton, both of PA (US)

(73) Assignee: Bell & Howell Mail and Messaging Technologies Company, Durham, NC (US)

( * ) Notice: Subject to any disclaimer, the term of this patent is extended or adjusted under 35 U.S.C. 154(b) by 0 days.

(21) Appl. No.: 09/293,397

(22) Filed: Apr. 16, 1999

(51) Int. Cl.[7] ..... B65H 5/02; B65H 5/04; B65H 31/04; B65H 9/10

(52) U.S. Cl. ..... 271/213; 271/233; 271/272

(58) Field of Search ..... 271/272, 209, 271/213, 223

(56) References Cited

U.S. PATENT DOCUMENTS

| | | | | |
|---|---|---|---|---|
| 4,009,878 | * | 3/1977 | Scheck | 271/272 |
| 4,018,433 | * | 4/1977 | Woods | 271/80 X |
| 4,640,506 | | 2/1987 | Luperti et al. . | |
| 5,083,769 | * | 1/1992 | Young, Jr. | 271/280 X |
| 5,123,639 | * | 6/1992 | Edwards | 271/212 X |
| 5,147,092 | * | 9/1992 | Driscoll et al. | 271/184 X |
| 5,244,200 | * | 9/1993 | Manzke | 371/198 |
| 5,590,873 | * | 1/1997 | Smart et al. | 271/303 |
| 5,692,745 | * | 12/1997 | Neifert et al. | 271/198 |
| 5,775,689 | * | 7/1998 | Moser et al. | 271/198 |
| 5,915,687 | * | 6/1999 | Rieck | 271/207 |
| 5,954,473 | * | 9/1999 | Folsom | 414/788.9 X |

FOREIGN PATENT DOCUMENTS

| | | | | |
|---|---|---|---|---|
| 360197546 | * | 10/1985 | (JP) | 271/272 |

* cited by examiner

*Primary Examiner*—H. Grant Skaggs
*Assistant Examiner*—Kenneth W Bower
(74) *Attorney, Agent, or Firm*—Jenkins & Wilson, P.A.

(57) ABSTRACT

A sheet-size and stacking direction adjustable accumulator and method are disclosed. The accumulator is easily adjustable for handling sheets of different widths and for either under or over accumulating. The adjustability is provided by allowing accumulator ramps to be added or removed without having to deconstruct the accumulator and without the need for special skill.

15 Claims, 6 Drawing Sheets

SHEET-SIZE AND STACKING DIRECTION ADJUSTABLE ACCUMULATOR WITH REMOVABLE RAMPS AND METHOD

RELATED PATENTS

The invention described herein is related to the inventions disclosed and/or claimed in U.S. Pat. Nos. 5,244,200 and 5,590,873, both assigned to the present assignee and both of whose contents are entirely incorporated herein by reference.

TECHNICAL FIELD

The present invention relates generally to sheet accumulator apparatuses and methods. More particularly, the present invention relates to a sheet-size and stacking direction adjustable accumulator and method.

BACKGROUND OF THE INVENTION

The use of accumulators to gather or accumulate individual sheets into groups of sheets is well known in the paper handling arts. Such devices send sheets seriatim towards an accumulating area where the sheets accumulate either one on top of the other ("over-accumulating") or one below the other ("under-accumulating").

A problem that has been faced in accumulators to-date concerns the use of a single accumulator to accumulate sheets of differing size. In the instant invention, the difference in size contemplated concerns differences in width between sheets. To meet the requirement that the accumulator may handle sheets of differing widths, the accumulator needs to be adjustable in the transverse direction in some manner.

A second problem which has been faced in accumulators to-date concerns the changing from over to under accumulating and vice-versa without the need for substantial reconstruction of the accumulator.

While solutions that make accumulators adjustable with respect to sheet width have been offered (U.S. Pat. No. 5,244,200 and U.S. Pat. No. 5,590,873), as will be described below, each has its limitations. Furthermore, there are no accumulators out in the market that allow for the easy changing from over to under accumulating.

Accordingly, there remains room for improvement within the art of sheet accumulators.

OBJECTS OF THE INVENTION

It is an object of the present invention to provide a sheet-size and stacking direction adjustable accumulator that can be easily adjusted to handle sheet material of different widths.

It is a further object of the present invention to provide a sheet-size and stacking direction adjustable accumulator that can be easily adjusted to handle sheet material of different widths without having to deconstruct the accumulator.

It is still yet a further object of the present invention to provide a sheet-size and stacking direction adjustable accumulator that can be easily adjusted to handle sheet material of different widths and which requires no special skill to modify or adjust.

It is still yet a further object of the present invention to provide a sheet-size and stacking direction adjustable accumulator that can also be easily changed from over to under accumulating.

These and other objects of the invention are achieved by a sheet-size and stacking direction adjustable accumulator, comprising a conveyor mechanism for moving sheets along a sheet path and towards an accumulation area, and at least one ramp for deflecting said sheet into said accumulation area, said at least one ramp removable from said accumulator without having to deconstruct said accumulator.

BRIEF DESCRIPTION OF THE DRAWINGS

FIGS. 5A–C of the drawings are side elevation views of yet additional embodiments of a ramp for use with the accumulator according to the present invention.

DETAILED DESCRIPTION OF THE INVENTION

With reference to the attached drawings, a sheet-size and stacking direction adjustable accumulator that meets and achieves the various objects of the invention set forth above will now be described.

Figure 1A:
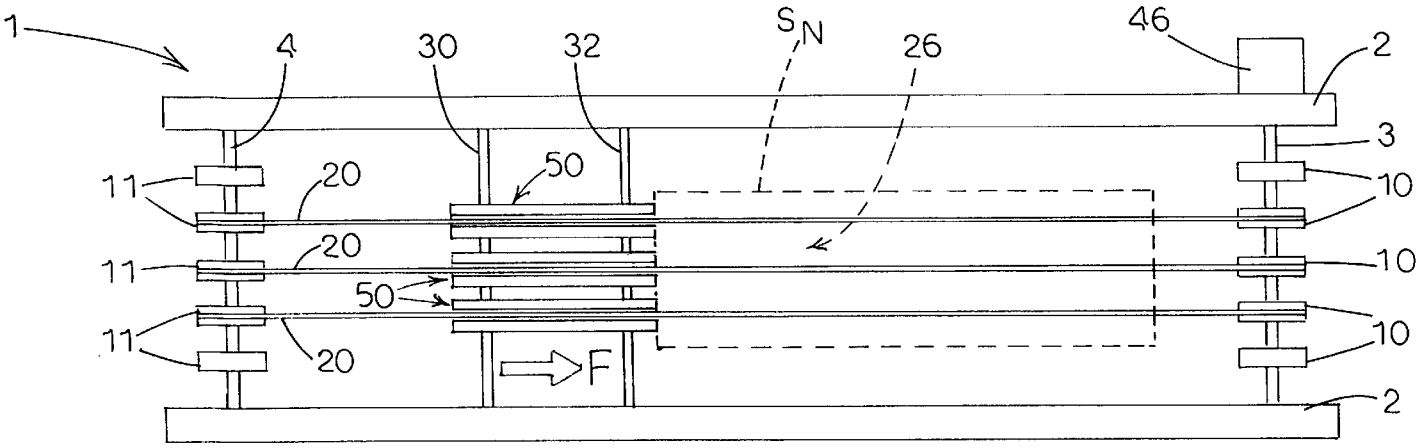
FIG. 1A of the drawings illustrates a plan view of a sheet-size and stacking direction adjustable accumulator according to the invention and configured to accumulate narrower sheets.
Figure 1B:
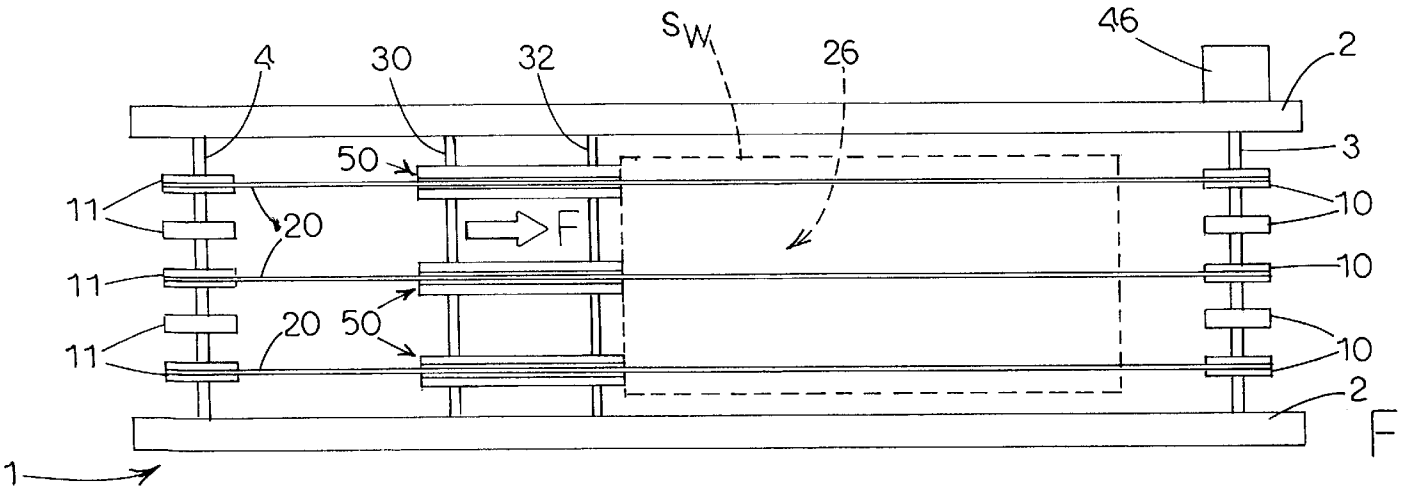
FIG. 1B of the drawings illustrates a plan view of a sheet-size and stacking direction adjustable accumulator according to the invention and configured to accumulate wider sheets.
Figure 2A:
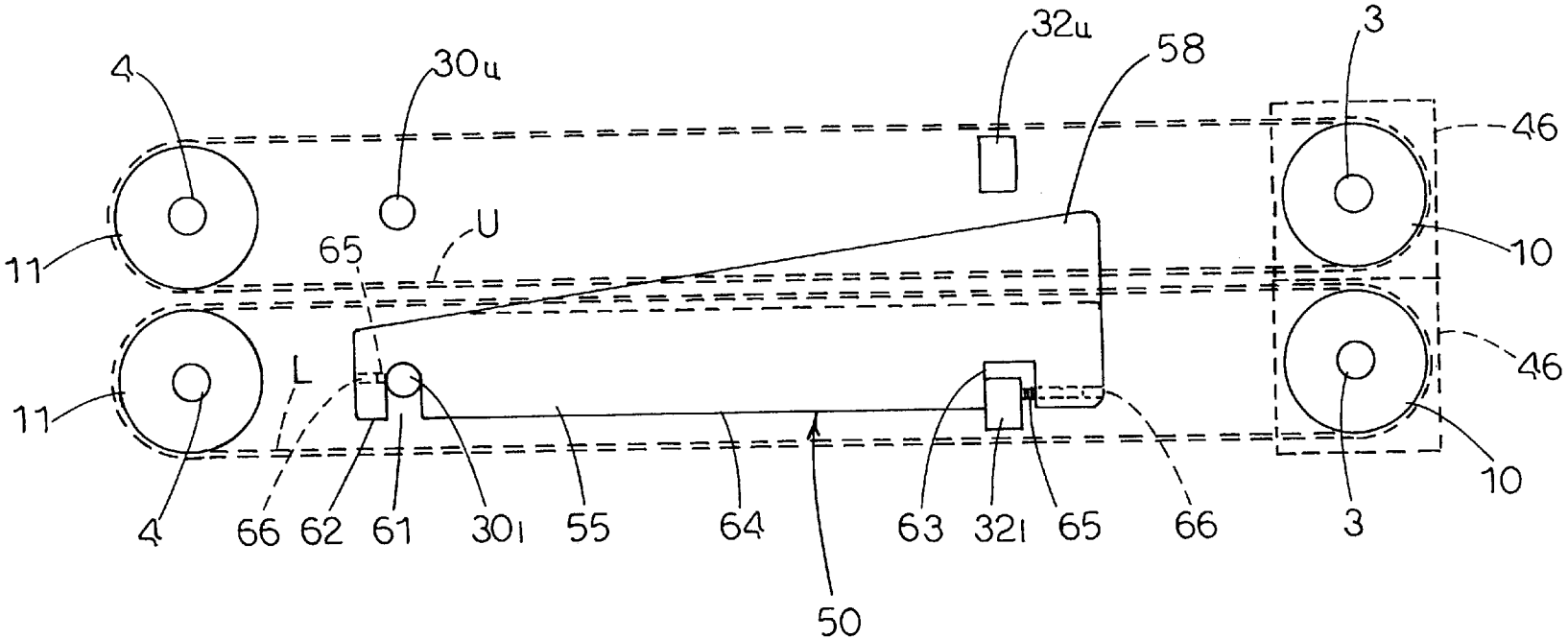
FIG. 2A of the drawings is an elevation view of the sheet-size and stacking direction adjustable accumulator according to the invention and configured for over accumulation.
Figure 2B:
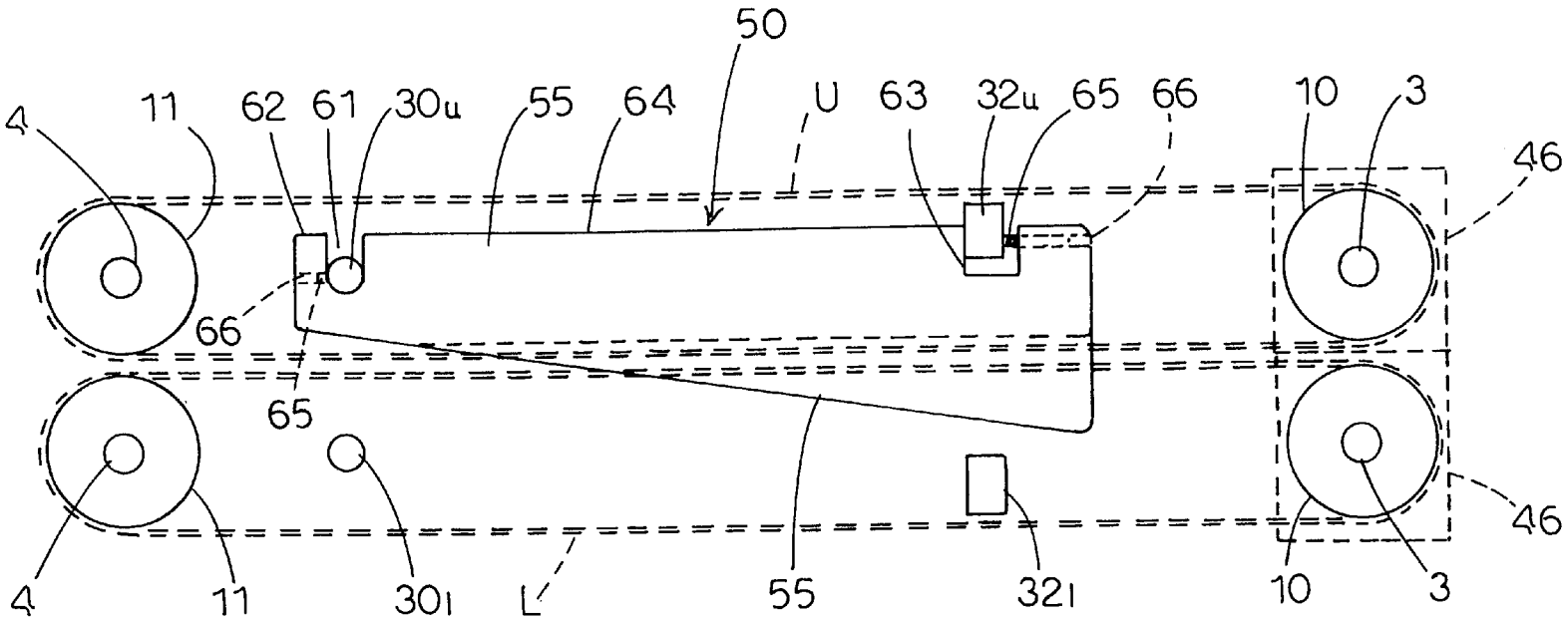
FIG. 2B of the drawings is an elevation view of the sheet-size and stacking direction adjustable accumulator according to the invention and configured for under accumulation.

FIGS. 1A, 1B illustrate plan views of a sheet-size and stacking direction adjustable accumulator 1 according to the invention. Accumulator 1 comprises side plates 2 with a number of conveyor mechanisms rotatably mounted thereto, and in the form of upper U and lower L conveyor assemblies (FIGS. 2A, 2B). Each conveyor assembly U, L (FIGS. 2A, 2B) comprise a belt 20 retained between pulleys 10, 11 positioned at the same transverse position along the width of the sheet path. Pulleys 10, 11 are mounted on shafts 3, 4 and mounted to rotate with shafts 3, 4. Belts 20 are preferably the "round" poly-cord type, also known in the art as "spaghetti belts". Motion of belts 20 is accomplished via a conventional drive mechanism 46 mechanically connected to one of shafts 3, 4 for driving that shaft and therefore moving belts 20 to drive sheets down a sheet path in the direction of arrow F towards stacking area 26.

Accumulator 1 also comprises at least one removable and adjustable ramp assembly 50 disposed upstream from accumulating or stacking area 26 and for deflecting a sheet into the accumulation area 26. Ramp assemblies 50 are supported inside accumulator 1 by use of pivot shaft 30 and support shaft 32. In particular, ramp assemblies 50 are supported within the runs of conveyor assembly U by pivot shaft 30*u* and support shaft 32*u* and within the runs of conveyor assembly L by pivot shaft 301 and support shaft 321.

Figure 3:
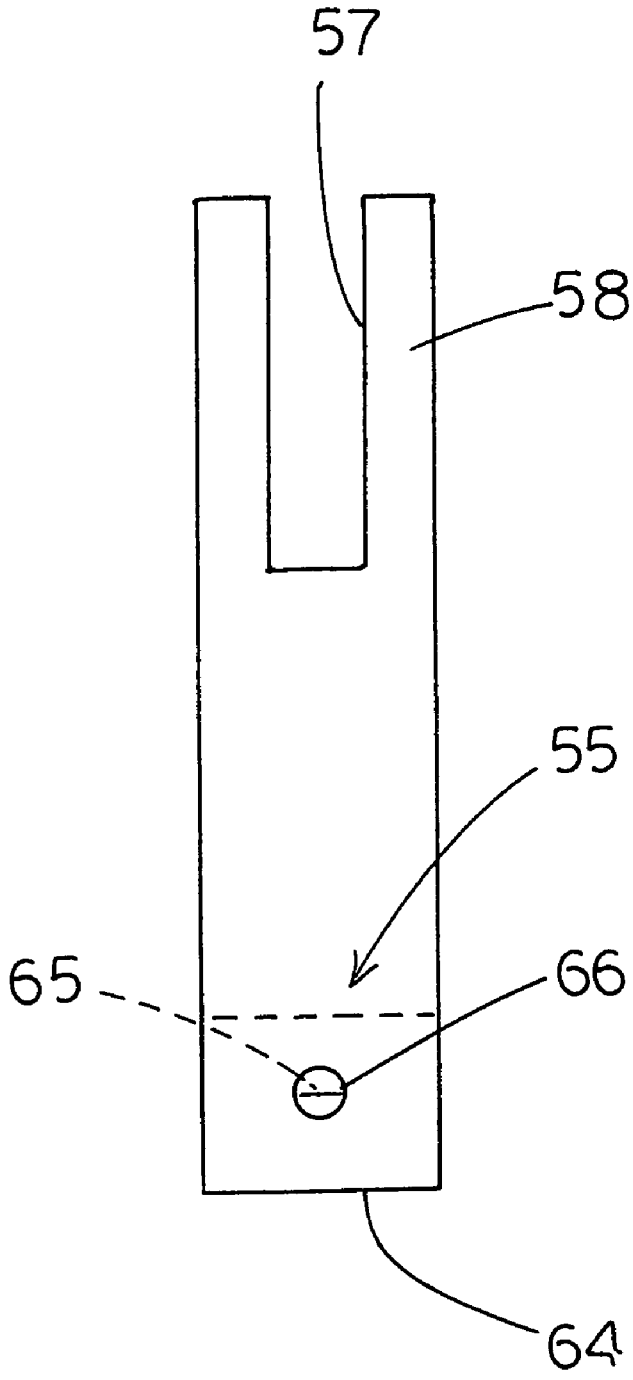
FIG. 3 of the drawings is a rear elevation view of a ramp for use with the accumulator according to the invention.

One embodiment of adjustable ramp assemblies 50 comprises at least one ramp 55 having a groove 57 (FIG. 3) in the angular portion 58 thereof for passage of upper U and lower L conveyor assemblies (FIGS. 2A, 2B) therethrough. Ramp 55 also has a sidewardly opening slot 61 in the tapered portion 62 thereof and a locking slot 63 in base portion 64 thereof. Ramps 55 are supported inside accumulator 1 by pivot shaft 30 being held within sidewardly opening slot 61 and support shaft 32 being supported in locking slot 63 as described in particular detail above. While the use of one shaft is possible, the use of two is preferred. The use of two shafts provides for a steadier base for ramps 55 and also acts as a means for preventing the rotation and/or movement of ramps 55. Pivot shaft 30 will typically be a round shaft while support shaft 32 will be a square shaft. The cross section of slots 61, 63 will correspond to those of shafts 30, 32, respectively. Ramps 55 further includes an arresting mechanism used to clamp and/or arrest ramp 55 in its proper transverse position in the sheet path and on shafts 30, 32. In one embodiment of the invention, the arresting mechanism may be in the form of a set screw 65 contained within threaded bores 66 for locking ramp 55 into position on some point along the top of shafts 30, 32; the positioning being determined by the sheet width being used with accumulator 1 at the time. In the alternative embodiment of FIG. 4, the arresting mechanism can comprise spring 151 loaded ball bearings 150 contained within bores 133. As one skilled in the art can be gleam from this figure and description, the alternative embodiment requires no tools to implement.

Having described the general features of the preferred embodiment of a sheet-size and stacking direction adjustable accumulator 1 according to the invention, how accumulator 1 can be easily reconfigured for sheets of various paper sizes will now be described.

As depicted in FIG. 1A, accumulator 1 is configured for the accumulation of relatively narrow sheets $S_N$. For such accumulation, belts 20 are positioned on pulley pairs 10, 11, that congregate belts 20 towards the center of the sheet path and covering a transverse distance close in width to that of sheets $S_N$.

If the accumulator operator then wishes to feed wider sheets $S_W$ (FIG. 1B), according to the structure of the invention, this conversion can be easily and quickly achieved. The goal in this conversion is to assure that almost the entire sheet width is held between belts 20 and acted upon by ramps 55. Therefore, belts 20 would be moved further apart to cover more of the width of sheets $S_W$. As depicted in FIG. 1B, that would entail moving the outermost belts 20 (in solid) onto outermost pulleys 10, 11. While the attached drawings depict each pulley 10, 11, as a discrete and separate pulley, it is equally possible that pulleys 10, 11, comprise two multi-grooved pulleys as depicted in U.S. Pat. No. 5,590,873. Belts 20 would then grasp the sheet along more of its width and therefore provide for better sheet control and sheet handling.

For sheet-size and stacking direction adjustable accumulator 1 to be configured for a different paper width, however, one or more ramps 55 will also need to be repositioned and/or removed or added in accordance with the width of the sheet to be accumulated. That is, for larger sheet widths, ramps 28 need to be further apart for the same reason that for wider sheets belts 20 need to be further apart; i.e., to effect more of the sheet along its length. Through the structure of ramp assemblies 50 described herein, ramps 55 can be positioned or repositioned anywhere across the transverse sheet path. The positioning and repositioning of ramps 55 is achieved by merely releasing the ramp's arresting means and removing ramp 55 from shafts 30, 32, replacing ramps 55 at another position along the lengths of shafts 30, 32, and engaging the arresting means.

While U.S. Pat. No. 5,590,873 contemplates the problem of needing ramps 28 to be moveable and therefore allows for the transverse sliding of ramps 28 across the sheet plane, this sliding alone does not solve the problem of the need for adding or removing ramps 28.

There are multiple reasons why additional ramps 55 might be desirable or existing ramps 55 removed. The first reason concerns the ability to convert the accumulating direction of an accumulator from over accumulation (stacking upward) to under accumulation (stacking downward). To convert from over accumulation to under accumulation, ramps 55 must be inverted. The inversion of ramps 55 result in the change from sheets being deflected upward (FIG. 2A) to sheets being deflected downward (FIG. 2B) by angular deflection portion 58. Another reason why ramps might need to be added or removed is related to the characteristics of the sheets being accumulated. For example, if a sheet is curled or dog-eared at some point, an additional ramp placed at that point may assure the proper accumulation. Accordingly, for at least these two reasons the ability to quickly add such a ramp 55 and then remove it when it is no longer needed would add to the flexibility and usefulness of the accumulator 1. To do this quickly and easily, ramps 55 must be able to be easily removed and replaced.

As can be understood from the drawings and description of U.S. Pat. No. 5,590,873, the addition or removal of ramps 28 in that accumulator requires a deconstruction of the accumulator depicted in that patent. As used herein and in the attached claims, "deconstruction" means having to add or remove substantial parts of the accumulator other than just the ramps 28 in order to add or remove ramps 55. Note that by deconstruction, the term is not meant to solely include the removal of small minor accumulator parts that may be removed in a short time period. Typically, this deconstruction will require tools, special skills, etc. Deconstruction is a time consuming step which is totally unacceptable in an environment such as when sheet sheet-size is changed on a frequent, e.g., daily, basis and by low-skilled machine operators rather than high-skilled service technicians.

As described above, the instant invention provides a quick and easy solution to the problem posed by U.S. Pat. No. 5,590,873 by allowing for the easy addition or removal of ramps 55 without the need for any deconstruction of accumulator 1 or special skills. To remove or reposition a ramp 55, a conventional screwdriver is used to release the arresting mechanism, in the form of set screw 33, thereby allowing for the removal of the ramp 55 from accumulator 1. To add a ramp 55 or place it in its different transverse position along the sheet path, shaft 30 is placed into slot 61 and shaft 32 is placed into slot 63. Then, again using a conventional screwdriver, set screw 33 is then tightened. While it is not necessary, detents (not shown) can be placed along the length of and into shaft 32 for receiving set screw 33.

For changing from over to under accumulating, as an example, the process is equally as simple. A conventional screwdriver is used to release the arresting mechanism, in the form of set screw 33, thereby allowing for the removal of the ramp 55 from accumulator 1 by removing pivot shaft 301 from slot 61 and support shaft 321 from slot 63. Ramp 55 is then inverted with pivot shaft 30*u* being placed into slot 61 and support shaft 32*u* being placed into slot 63. Then, again using a conventional screwdriver, set screw 33 is then tightened. While it is not necessary, detents (not shown) can be placed along the length of and into shaft 32 for receiving set screw 33. It can be seen that to change the device from under to over accumulating, ramp 55 is removed from pivot shaft 30*u* and support shaft 32*u,* inverted, and placed on pivot shaft 301 and support shaft 321 in generally the same manner as described immediately above.

Figure 4:
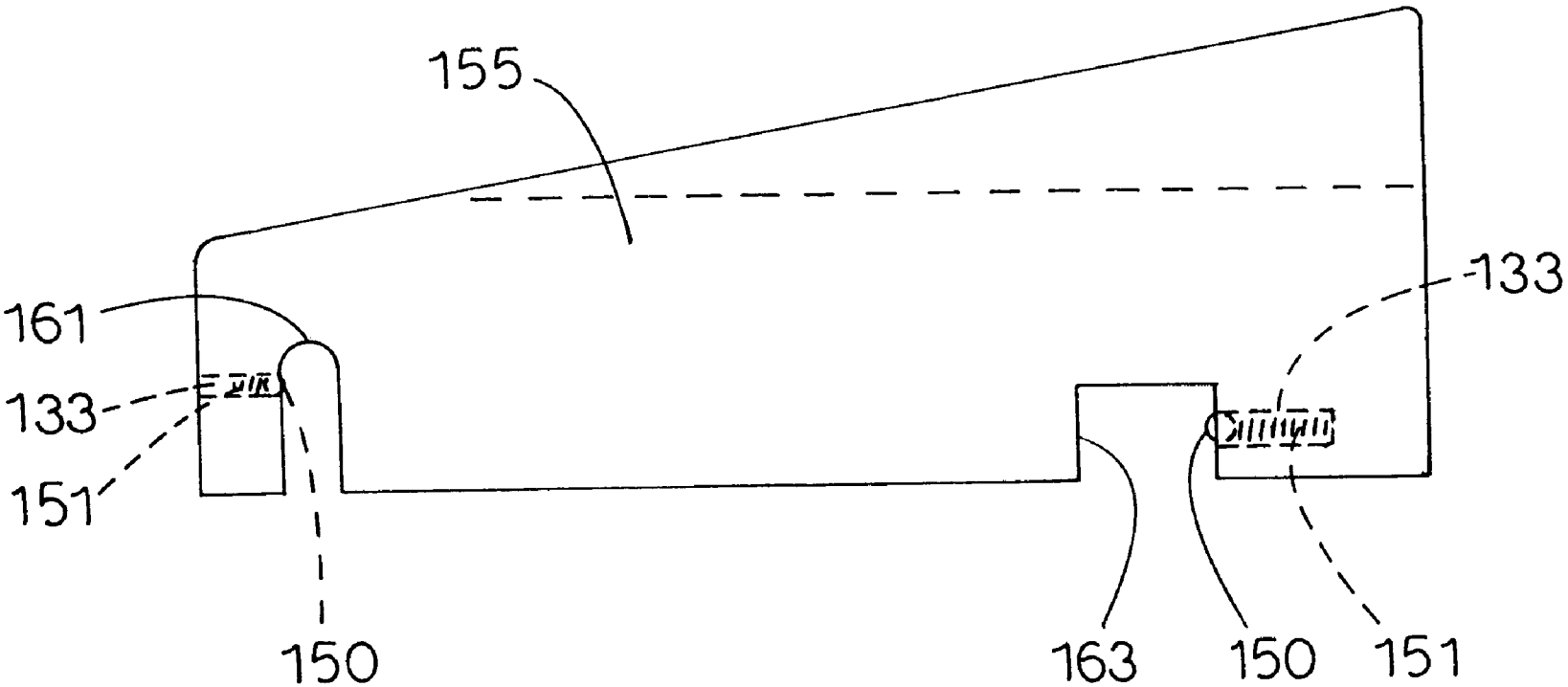
FIG. 4 of the drawings is a side elevation of a second embodiment of a ramp for use with the accumulator according to the invention.

Similarly, using the alternative embodiment of FIG. 4, ramps 155 may easily be snapped in and out of place in accumulator 1 at any position and in either configuration (under or over accumulating) along shafts 30*u,* 301, 32*u,* 321.

Figure 5A:
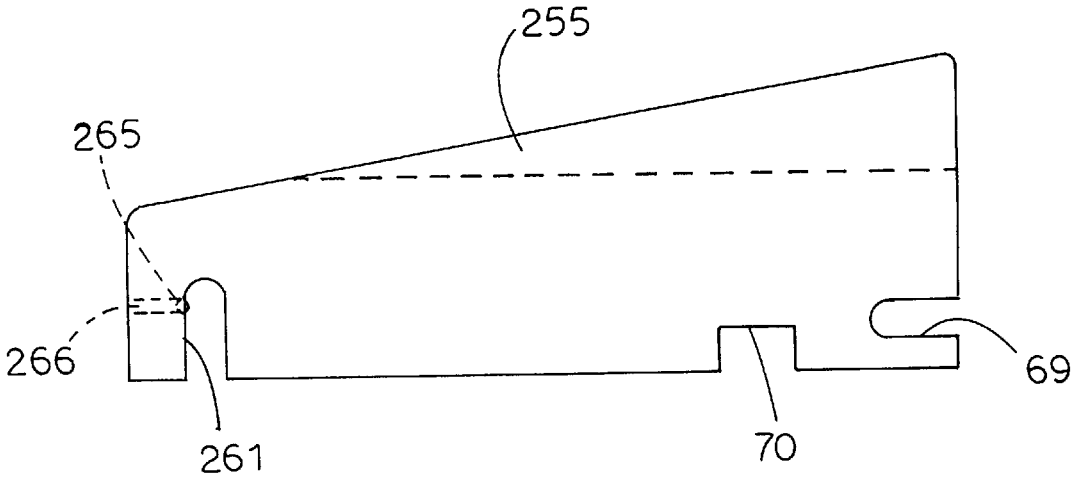
Figure 5B:
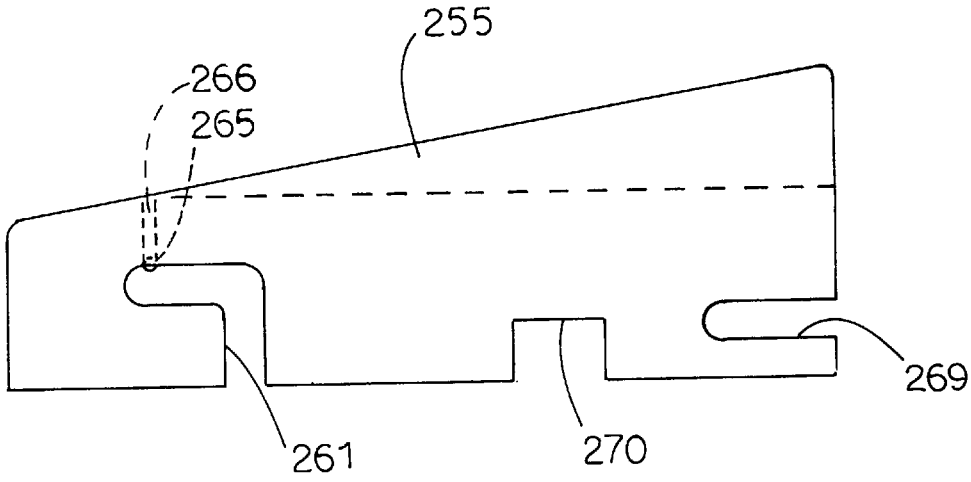

Yet two additional alternative embodiments of ramps 255 are shown in FIGS. 5A and 5B. Each of these alternative embodiments are similar in that they use a three-shaft structure to support ramps 255. In particular, each of lead slot 261, trail slot 269 and support slot 270 will receive some type of shaft or bar (not shown). As in the primary embodiment, set screws 265 positioned within threaded bores 266 can be used to secure ramps 255 in position. Similarly, spring-loaded ball bearings may be used, as described above. The differences in configuration of lead slot 261 allow for different pivot bar placement positions and increased flexibility in positioning.

As can be seen from the description, the ramp structure described here in allows the accumulator to be quickly and easily configured for paper widths ranging from, e.g., 6 inches wide to 12 inches wide, and without having to deconstruct the accumulator and without requiring any special skill on the part of the operator.

The above description is given with reference to a sheet-size and stacking direction adjustable accumulator and method. However, it will be understood that various details of the invention may be changed without departing from the scope of the invention. Furthermore, the foregoing description is for purpose of illustration only, and not for purpose of limitation, as the invention is defined by the following, appended claims.

That which is claimed:

1. A sheet-size and stacking direction adjustable accumulator, comprising:

(a) a conveyor mechanism for moving sheets along a sheet path and towards an accumulation area; and (b) at least one ramp for deflecting sheets in an over accumulation manner in a first direction, said at least one ramp removable from said accumulator without having to deconstruct said accumulator and said at least one ramp being invertible for deflecting sheets in an under accumulation manner in a second direction.

2. The sheet-size and stacking direction adjustable accumulator according to claim 1, wherein:

(a) said accumulator has at least one shaft traversing the sheet path;

(b) said ramp has at least one slot; and (c) wherein said ramp is supported by said accumulator said shaft being at least partially received in said slot.

3. The sheet-size and stacking direction adjustable accumulator according to claim 2, wherein said ramp further comprises an arresting mechanism for arresting said shaft inside said slot.

4. The sheet-size and stacking direction adjustable accumulator according to claim 3, wherein said arresting mechanism comprises a set screw.

5. The sheet-size and stacking direction adjustable accumulator according to claim 3, wherein said arresting mechanism comprises a spring-loaded ball bearing.

6. The sheet-size and stacking direction adjustable accumulator according to claim 2, further comprising means for preventing the rotation of said ramp.

7. The sheet-size and stacking direction adjustable accumulator according to claim 6, wherein said means for preventing the rotation comprises a second shaft and a second slot in said ramp for receiving said second shaft.

8. A method of accumulating sheets, comprising the steps of:

(a) providing a sheet accumulator having a sheet accumulating area;

(b) conveying sheets down a sheet path and towards said sheet accumulating area;

(c) providing at least one ramp;

(d) positioning said at least one ramp inside said accumulator in accordance with the width of the sheet to be accumulated;

(e) using said at least one ramp to deflect sheets into said sheet accumulating area; and (f) adjusting the number and positioning of ramps across a transverse sheet plane in accordance with the width of the sheet to be accumulated.

9. The method according to claim 8, wherein said step of adjusting further comprises the step of:

(a) adding or removing ramps without having to deconstruct said accumulator.

10. The method according to claim 9, wherein said step of providing at least one ramp comprises:

(a) providing at least one ramp having at least partially downwardly opening slots for receiving shafts associated with said accumulator.

11. The method according to claim 10, wherein said step of providing at least one ramp further comprises:

(a) providing said at least one ramp with an arresting mechanism for arresting said ramp to said shafts.

12. The method according to claim 11, wherein said step of providing said arresting mechanism comprises:

(a) providing said ramp with a spring-loaded ball bearing.

13. The method according to claim 11, wherein said step of providing said arresting mechanism further comprises:

providing said ramp with a set screw.

14. A method of reversing the direction in which sheets are stacked in an accumulator, comprising the steps of:

(a) providing a sheet accumulator apparatus;

(b) providing said sheet accumulator with ramps configured for stacking sheets in a first direction;

(c) removing said ramps; and (d) replacing said ramps in an inverted configuration for stacking sheets in a second direction.

15. The method of claim 14, wherein said steps of removing and replacing said ramps is done without having to deconstruct said accumulator.

* * * * *